US006282936B1

(12) United States Patent
Blazley

(10) Patent No.: US 6,282,936 B1
(45) Date of Patent: Sep. 4, 2001

(54) COLD-FORMING PROCESS AND APPARATUS

(75) Inventor: Wade Hylton Blazley, Carcoar (AU)

(73) Assignee: Ausarch Pty. Ltd., Mosman (AU)

( * ) Notice: Subject to any disclaimer, the term of this patent is extended or adjusted under 35 U.S.C. 154(b) by 0 days.

(21) Appl. No.: 09/462,380

(22) PCT Filed: Jul. 3, 1998

(86) PCT No.: PCT/AU98/00517

§ 371 Date: Apr. 3, 2000

§ 102(e) Date: Apr. 3, 2000

(87) PCT Pub. No.: WO99/02795

PCT Pub. Date: Jan. 21, 1999

(30) Foreign Application Priority Data

Jul. 7, 1997 (AU) ..... PO 7742

(51) Int. Cl.[7] ..... B21D 11/20; B21D 13/02

(52) U.S. Cl. ..... 72/176; 72/307; 72/379.6

(58) Field of Search ..... 72/176, 129, 307, 72/379.6, 385

(56) References Cited

U.S. PATENT DOCUMENTS

| | | | | |
|---|---|---|---|---|
| 2,960,140 | * | 11/1960 | Anderson | 72/176 |
| 3,009,509 | * | 11/1961 | Martin . | |
| 3,433,043 | * | 3/1969 | Vermeulen | 72/176 |
| 3,664,170 | * | 5/1972 | Davis | 72/379.6 |
| 3,874,214 | * | 4/1975 | Racicot | 72/307 |
| 3,967,430 | | 7/1976 | Knudson . | |
| 4,364,253 | | 12/1982 | Knudson | 72/181 |
| 4,424,727 | | 1/1984 | Mader | 72/107 R |
| 4,624,121 | * | 11/1986 | Kitsukawa | 72/307 |
| 4,759,159 | | 7/1988 | Blazley . | |
| 4,881,355 | | 11/1989 | Bosl et al. . | |
| 4,896,466 | | 1/1990 | Blazley . | |
| 5,249,445 | | 10/1993 | Morello | 72/177 |
| 5,884,517 | * | 3/1999 | Yogo | 72/307 |

FOREIGN PATENT DOCUMENTS

48883/90 8/1990 (AU) .

* cited by examiner

*Primary Examiner*—Daniel C. Crane
(74) *Attorney, Agent, or Firm*—Larson & Taylor PLC

(57) ABSTRACT

This invention relates to sheet metal buildings of relatively large size and more particularly but not exclusively to processes and apparatus for cold-forming elongate building elements of such buildings and methods of building construction. The invention provides in one aspect cold-forming dies 30, mounted on intermediate transverse members 21 of a frame 1, comprising a set of coextensive generally in register dies between which the strip is received. The set comprises a male die 22 having a concave leading edge 24 and a female die 23 having a convex leading edge 18. The male die 22 and female die 23 are driven towards one another to plastically deform the strip 6 into a channel section. The concave leading edge 24 is provided with a coextensive protrusion 26 and the convex leading edge is provided with a coextensive recess 27. At the same time that the dies 22, 23 mate to plastically deform the strip 6 into a channel section the protrusion 26 and recess 27 of the respective dies 22, 23 mate to form a transverse rib 28 in the strip 6.

34 Claims, 10 Drawing Sheets

COLD-FORMING PROCESS AND APPARATUS

This application is a 371 of PCT/AU98/00517, filed Jul. 3, 1998.

TECHNICAL FIELD

This invention relates to sheet metal buildings of relatively large size and more particularly but not exclusively to processes and apparatus for cold-forming elongate building elements of such buildings and methods of building construction.

BACKGROUND ART

The invention is particularly described with reference to longitudinally arcuate building elements. Typically building elements of this kind have been used to construct farm buildings, garages and the like of upwardly convexed arched structure comprising a plurality of prefabricated longitudinally arcuate elements that extend continuously from one side foundation of the building to the other arranged side by side with their abutting edges secured together thereby forming a stand alone building devoid of bracing, trusses or other structural reinforcements.

Traditionally the elements have been formed in two or more passes through roll forming apparatus or have required very long roll forming lines. Conventional processes and apparatus generally produce relatively short span elements which for long span buildings have been joined end to end with overlapping edge margins. Consequently, in constructing long span buildings, typically the short span elements are either joined end to end on the ground prior to being hoisted into position alongside previously erected elements and subsequently secured thereto edge to edge or are hoisted into their desired position individually for joining end to end and side to side with previously erected elements.

Both methods of construction are labour intensive and expensive.

Previously proposed buildings of this kind have not proven popular from either a commercial or manufacturing aspect. This appears due principally to high costs involved in formation and transportation of thin sheet metal elements of this kind and to handling difficulties and other constructional problems associated with such elements. Hence it is preferred that the formation of the building elements takes place at the site of the building to be erected. However, it has been found that conventional apparatus requires very long forming lines with a multiplicity of sets of forming rollers and as such have been somewhat impractical.

To address these problems the present inventor has previously proposed in Australian Patent application no. 48883/90 a method of erecting such buildings and apparatus for forming building elements of the above kind. Although the proposal goes a long way towards providing an effective and efficient solution to these problems it has been found that the proposed apparatus does not have sufficient operational flexibility to provide for building spans exceeding 20 meters. Additionally said apparatus is not sufficiently operationally flexible to provide adjustment of radius of curvature of the elements during operation and/or without considerable rearrangement and realignment of equipment and time loss.

An object of the present invention is to provide a process and apparatus which addresses one or more problems and deficiencies identified above or later in the specification.

SUMMARY OF THE INVENTION

The present invention provides apparatus for forming an elongate longitudinally arcuate building element of channel cross-section having transverse ribs from sheet metal comprising a set of coextensive generally in register dies through which a sheet of metal can be received, said set comprising a male die and a female die which cooperate to form transverse ribs in the sheet wherein further one of said male die and female die is provided with a concave leading edge and the other die is provided with a convex leading edge thereby the dies cooperate to plastically deform the sheet into a channel section.

It is preferred that the male die is provided with an upright protrusion projecting from its leading edge and extends along at least part of its length.

It is also preferred that the female die is provided with a coextensive recess extending along at least part of its length.

More preferably, both the protrusion and the recess extend a major portion of their respective edges.

It is preferred that the leading edges remain in register during operation of the apparatus.

Preferably the dies are provided with orbital motions which cooperate to bring the dies into engagement with the sheet, draw the sheet along a transit path therebetween while cold-forming the sheet and then disengage the sheet with each sweep about their orbits.

It is preferred that the dies are provided with means to adjust the radius of curvature of either or both the respective concave leading edge or the convex leading edge.

Adjustment of the radius of curvature of a leading edge may, for example, be effected by means of providing a female die formed of a plurality of segments held side to side having a gap provided between at least a portion of each of the segments, the width of the gap being adjustable so as to effect adjustment of the radius of curvature of the leading edge.

In one embodiment the die is formed of two substantially identical half segments.

Preferably the half segments are hinged to one another towards their leading end.

It is also preferred that the said set of dies are mounted on crank mechanisms to provide the dies with said cooperating orbital motions. In embodiments of this kind the dies may engage respective opposite sides of the sheet as it travels along a transit path through the apparatus, plastically deform the engaged portions of the sheet to form transverse ribs and advance with the sheet as deformation occurs, then release the sheet as it advances further along its transit path. Simultaneously the dies plastically deform the sheet into channel section by virtue of their respective concave and convex leading edges. This step may be repeated for each rib.

It has been found that the radius of longitudinal curvature of the element is closely related to the number of ribs per unit length of the element and as such is a function of both the speed of orbital motion of the dies and the speed of the sheet advancing along its transit path. It has also been found that the depth of the ribs also influence said curvature. The present invention facilitates rapid presetting of the radius of longitudinal curvature of the element by simple presetting of orbital motion speed and die intrusion length, without the need to alter sheet advancement speed and enables adjustment of said radius during operation of the apparatus by simple adjustment of the speed of orbital motion of the dies.

It is preferred also that guide means is provided in advance of the dies to receive the strip from a coil in a substantially flat configuration and pass the strip to a arcuate nip formed by the leading edges of the dies in a shape in cross-section corresponding generally to the shape in cross-section of the arcuate nip without plastically deforming the strip into said shape.

It is also preferred that drive means in the form of, for example, drive rollers is provided in advance of the guide means to drive the sheet in the form of strip from the coil to the dies through the guide means.

It is preferred that the apparatus further comprises edge flange forming means to operate on each longitudinal edge of the sheet.

More preferably the edge flange forming means comprise at least two pairs of cooperating edge forming rollers with each pair of rollers operating on a respective longitudinal edge to form flanged edges.

The flanged edges of each sheet may be formed as respective male and female formations so that two elements disposed side by side with overlapped flanged edges enable the male formation of one element to nestle in the female formation of the other element.

It is preferred that the sheets are provided from a coil of strip and that the apparatus further comprises shears to cut said strip into sheets of predetermined length. The shears may be disposed in advance of the forming dies so that discrete sheets pass through the forming dies or more preferably downstream thereof so that the cold-formed strip is cut into cold-formed elements.

It is preferred that the transverse ribs comprise corrugations. The corrugations may, for example be substantially sinusoidal in cross-section.

The crank mechanism may, for example, comprise four crankshafts rotatably supporting each die. Four bearing housings may be mounted on each die with two housings disposed on either edge margin of each die, one housing of said two housings being mounted towards the leading end of the die and the other towards the trailing end.

Each set of four crankshafts may be rotatably supported by eight bearing housings mounted on the frame, two housings for each crankshaft, and may be driven by an electric motor through a drive chain. The drive chain may, for example, comprise a chain and sprocket arrangement providing a gear reduction.

Four drive sprockets may drive the crankshafts of the male die and may rotate them in a clockwise direction and by running the back of the chains against the drive sprockets of the female die these sprockets may be driven counter-clockwise.

It is preferred that the dies are driven by means of a chain and sprocket arrangement whereby synchronisation of movement of the dies is facilitated.

The dies may be so geared to one another that they move towards one another to engage the strip received between them, advance with the strip along a transit path therebetween then disengage from the strip as they move further along their respective orbital path created by the movement of the crankshafts.

The offset of each crankshaft may, for example, provide each die with eccentric displacement with respect to the frame thereby providing the dies with both rotational and reciprocating action which permits continuity of strip feed.

The dies may thus be provided with both vertical and horizontal movement (as illustrated in FIGS. 10 to 13) as their cooperating respective concave and convex edges sweep said orbital path (in side view) without departing from their orientation towards one another. That is to say, the concave edge and the convex edge lie in register during operation.

The present invention also provides a process of forming an elongate longitudinally arcuate building element of channel cross-section having transverse ribs from sheet metal comprising the steps of; directing sheet metal to a nip of a set of dies, providing a set of coextensive generally in register dies having a nip through which a sheet of metal can be received, said set comprising a male die and a female die which cooperate to form transverse ribs in the sheet wherein further one of said male die and female die is provided with a concave leading edge and the other die is provided with a convex leading edge thereby the dies cooperate to plastically deform the sheet into a channel section and driving said dies to bring them together to form said transverse ribs in the sheet and to plastically deform the sheet into channel section prior to disengaging the cold-formed element.

It is preferred that the leading edges are held in register during operation of the apparatus.

Preferably the dies are provided with orbital motions which cooperate to bring the dies into engagement with the sheet, draw the sheet along a transit path therebetween while cold-forming the sheet and then disengage the sheet with each sweep about their orbits.

It is also preferred that the said set of dies are mounted on crank mechanisms to provide the dies with said cooperating orbital motions.

It is preferred that the process further comprises the step of edge flange forming each longitudinal edge of the sheet.

It is preferred that the process includes the step of providing metal sheets from a coil of strip and then cutting said strip into sheets of predetermined length.

The invention extends to a die for use in cold-forming apparatus said die having a leading end and a trailing end characterised in that the leading end is provided with an arcuate leading edge to cooperate with a leading edge of another die to plastically deform sheet metal into a channel section, the die being formed of a plurality of segments held side to side and a gap being provided between adjacent corners of the leading end of the segments, wherein the width of the gap is adjustable to effect adjustment of the radius of curvature of the arcuate leading edge.

It is also preferred that the die is formed of substantially identical half segments and that half segments are hinged to one another to effect said adjustment of the radius of curvature of the arcuate leading edge.

The present invention enables a sheet of metal to be formed into an elongate longitudinally arcuate building element of channel cross-section having transverse ribs in one pass through a single set of forming dies and obviates the need for a long transit path typical of conventional apparatus.

The present invention also provides cold-forming apparatus for cold-forming strip comprising cold-forming means to plastically deform the strip and support means to support the cold-forming means in a predetermined orientation characterised in that the support means enables the cold-forming means to be rotated about an axis substantially parallel to a travel path of the strip through the cold-forming means and held at one or more discrete orientations so that the formed strip issues from the apparatus at a desired orientation.

The present invention also provides cold-forming apparatus for cold-forming strip comprising a frame supporting cold-forming means to plastically deform the strip and strip guide means in advance of the cold-forming means, wherein the frame is provided with frame support means to support the frame in a predetermined orientation and wherein the frame support means enables the frame to be rotated about an axis substantially parallel to a travel path of the strip through the cold-forming means and held at one or more discrete orientations so that the formed strip issues from the apparatus at a desired orientation.

It is preferred that the guide means passes the strip to the cold-forming means and present the strip to the cold-forming means in a shape in transverse cross-section substantially corresponding to that to be formed by the cold-forming means.

BRIEF DESCRIPTION OF THE DRAWINGS

In order that the invention may be more fully explained one particular embodiment will be described in detail with reference to the accompanying drawings in which.

DESCRIPTION OF THE PREFERRED EMBODIMENT

Figure 1:
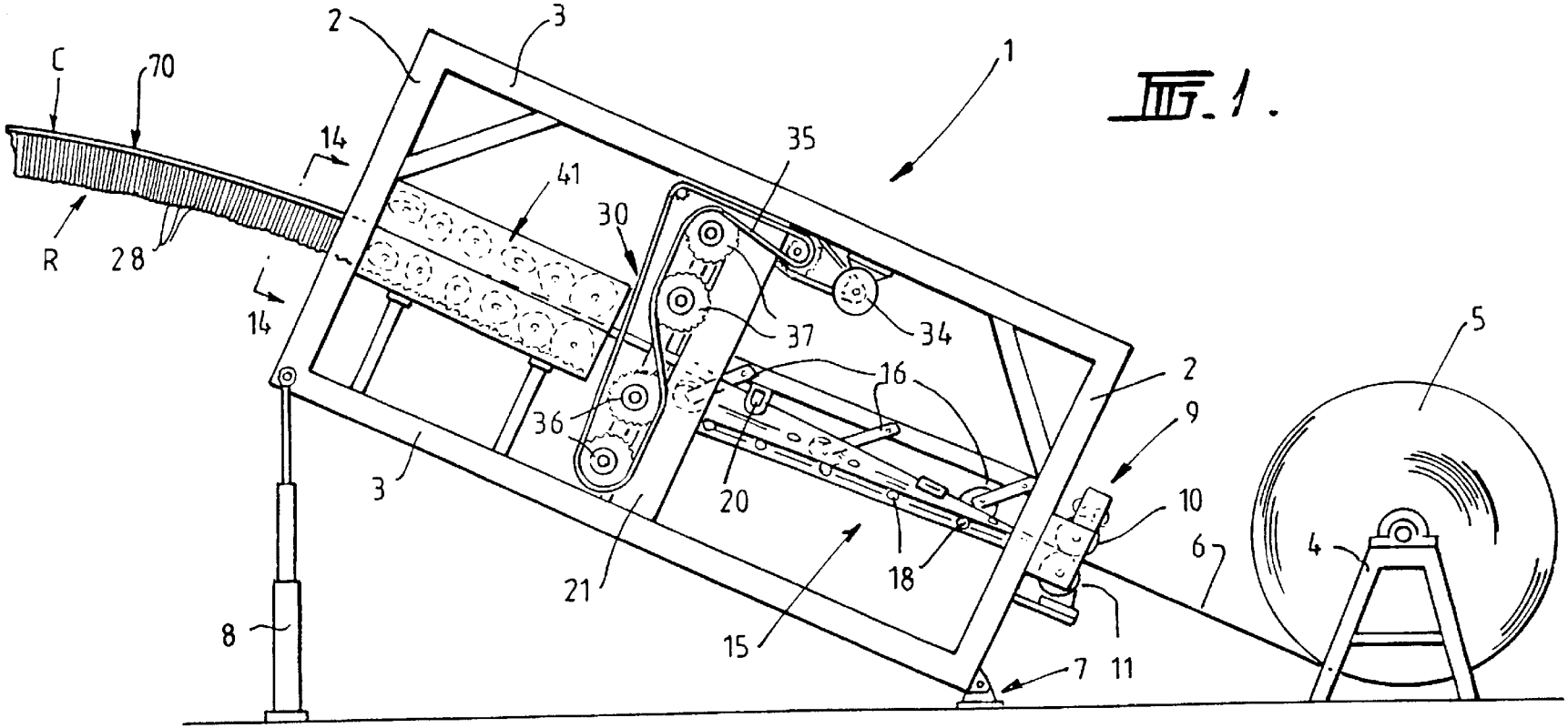
FIG. 1 is a schematic side elevation view of cold-forming apparatus in accordance with a preferred embodiment of one aspect of the invention.

FIG. 1 schematically illustrates a cold-forming machine in accordance with one embodiment of one aspect of the invention.

The machine comprises a frame 1 having transverse generally parallel and coextensive members 2, cross members 2' and longitudinal generally parallel and coextensive members 3 which are joined together to form a "box" configuration. The illustrated frame 1 has a height of 2 meters, a width of 1.67 meters and a length of 3.5 meters. The present invention thus facilitates cold-forming essentially flat strip into building elements of the requisite kind along a transit path that may extend less than 4 meters.

Towards the front of the machine, an uncoiler 4 is provided to support a coil 5 of metal strip 6. The coil 5 is rotatably mounted thereon to enable the strip 6 to be readily unwound. Typically the strip issuing from the coil has a thickness in the range of 0.8 to 1.2 millimeters and a width of about 1.245 meters.

The frame 1 is lifted about a transverse horizontal axis extending along a bottom edge 7 by a lifting mechanism 8. The lifting mechanism 8 comprises a hydraulic ram extending between the ground and the frame 1.

Alternatively the lifting mechanism may be a mechanical jack or other lifting device.

Mounted within the frame 1 are a set of cold-forming die means, edge forming means, guide means and strip drive means.

Figure 2:
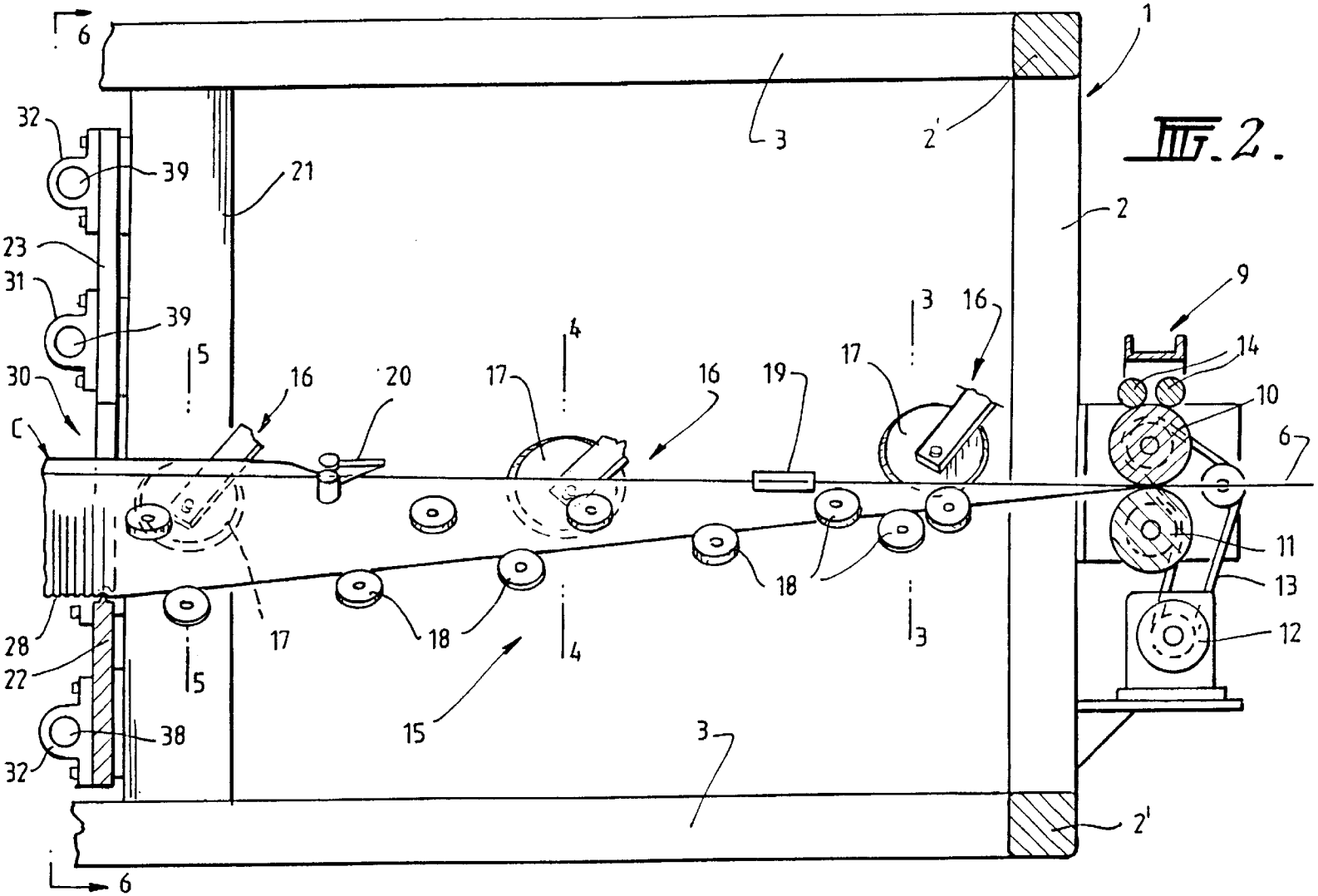
FIG. 2 is a schematic side view of important components of the cold-forming apparatus of FIG. 1

The strip drive means 9, as best seen and illustrated in FIGS. 1 and 2, comprises a pair of coextensive substantially parallel drive rollers 10, 11 between which strip 6 is received from the coil 5 and issued in a substantially flat configuration. The strip drive means also includes an electric motor 12 and a chain or belt drive 13 to drive rollers 10, 11. A pair of pressing rolls 14 are provided to enhance traction between the drive rollers and the strip 6. The strip drive means 9 is mounted to the frame 1 in advance of the guide means 15.

The guide means 15 is provided to pass the strip 6 to the cold-forming die means 30.

The die means 30 provides an arcuate nip 40 to receive the strip 6.

The guide means 15 presents the strip to the arcuate nip 40 in a shape corresponding generally to that arcuate shape in cross-section without plastically deforming the strip. That is to say, the strip 6 is passed to the nip 40 in an essentially channel shape without the strip 6 being plastically deformed into that shape.

As illustrated in FIGS. 2, 3, 4 and 5, the guide means 15 comprises a plurality of guide members mounted to the frame 1 in the form of a number of rotatable wheels 16 having elastomeric tire 17 disposed on one side of the strip 6, rolls 18 having elastomeric surfaces disposed on the other side of the strip 6, edge guides 19 to constrain lateral movement of the strip 6 and permit the edges of the strip to slide therethrough. Additional edge guides 20 disposed immediately in advance of the cold-forming die means 30 may be provided to enhance guiding of the strip and to bend the edge margins inwardly without plastic deformation thereof to enhance steering.

Figure 3:
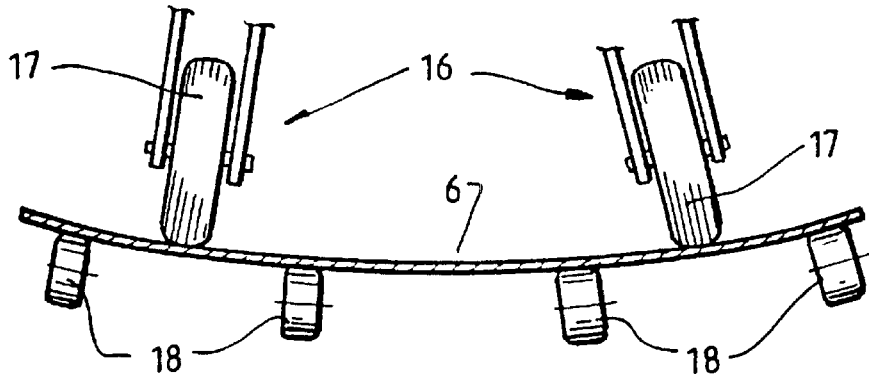
FIG. 3 is a schematic view of components illustrated in FIG. 2 taken along the lines 3—3.
Figure 4:
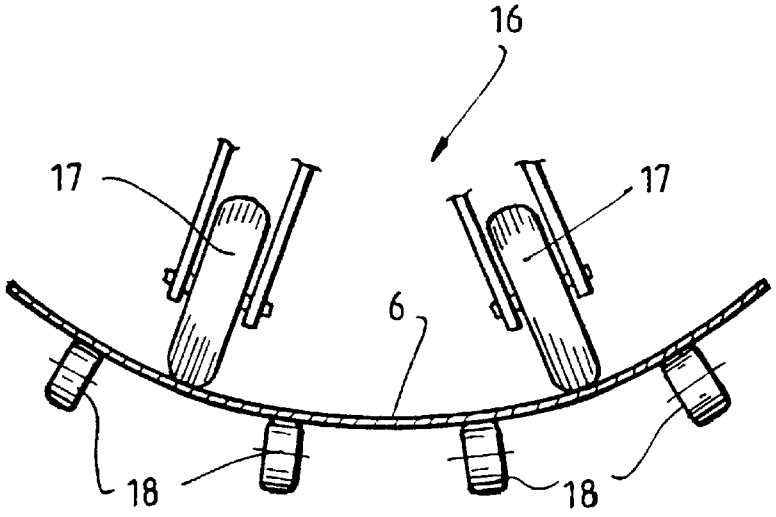
FIG. 4 is a schematic view of components illustrated in FIG. 2 taken along the lines 4—4.
Figure 5:
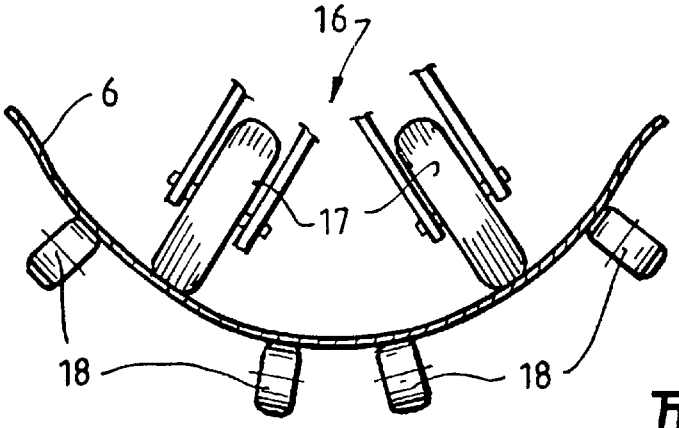
FIG. 5 is a schematic view of components illustrated in FIG. 2 taken along the lines 5—5.

FIGS. 3, 4 and 5 best illustrate the progressive change in shape of the strip 6 in transverse section from a flat sheet as it issues from the drive rollers 10, 11 to a channel shape as presented to the cold-forming die means 30 without plastic deformation as it passes the respective guides at locations indicated by lines 3—3, 4—4, and 5—5 respectively of FIG. 2.

Figure 6:
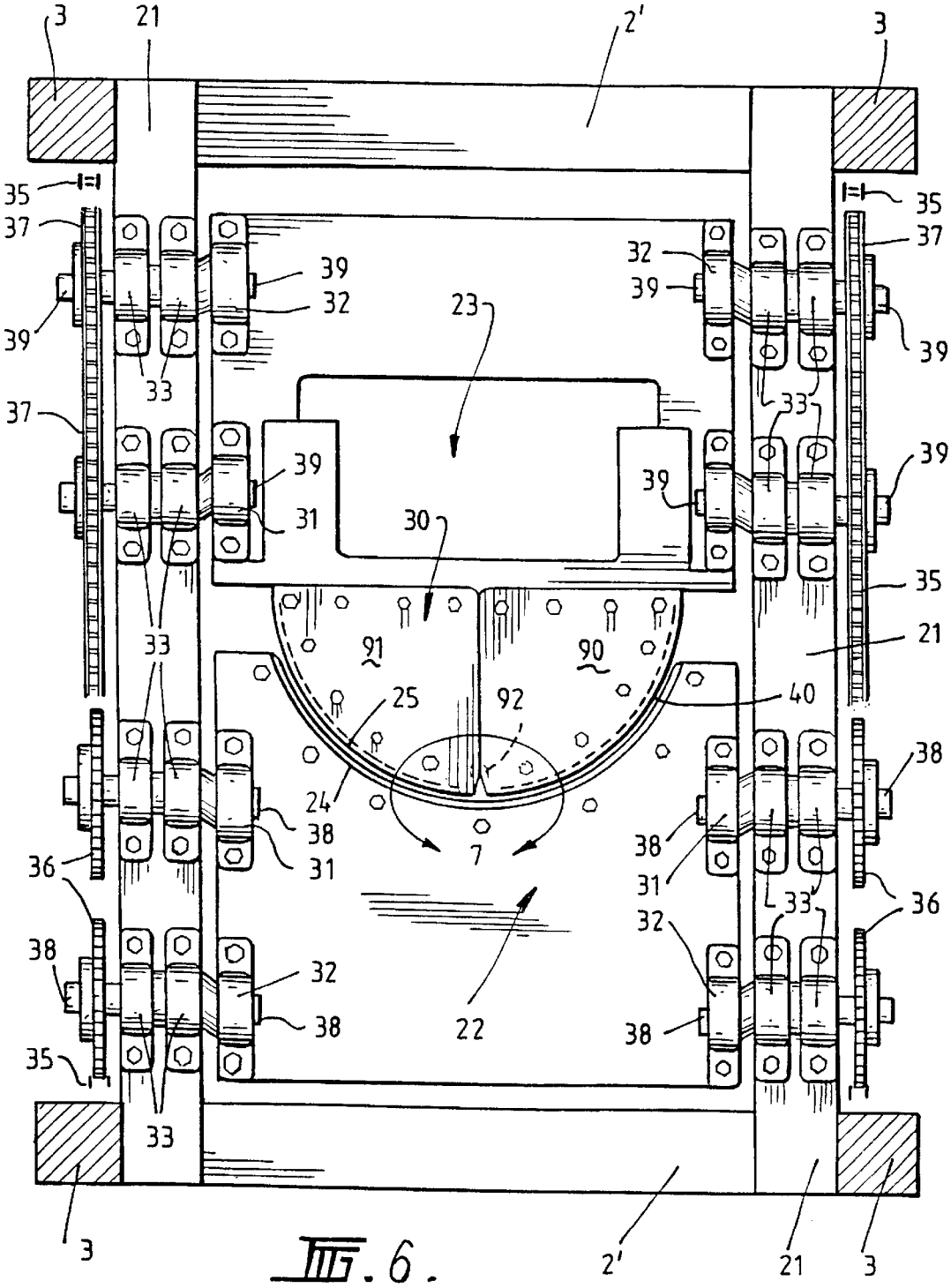
FIG. 6 is a schematic view of the apparatus illustrated in FIG. 2 taken along the lines 6—6.
Figure 7:
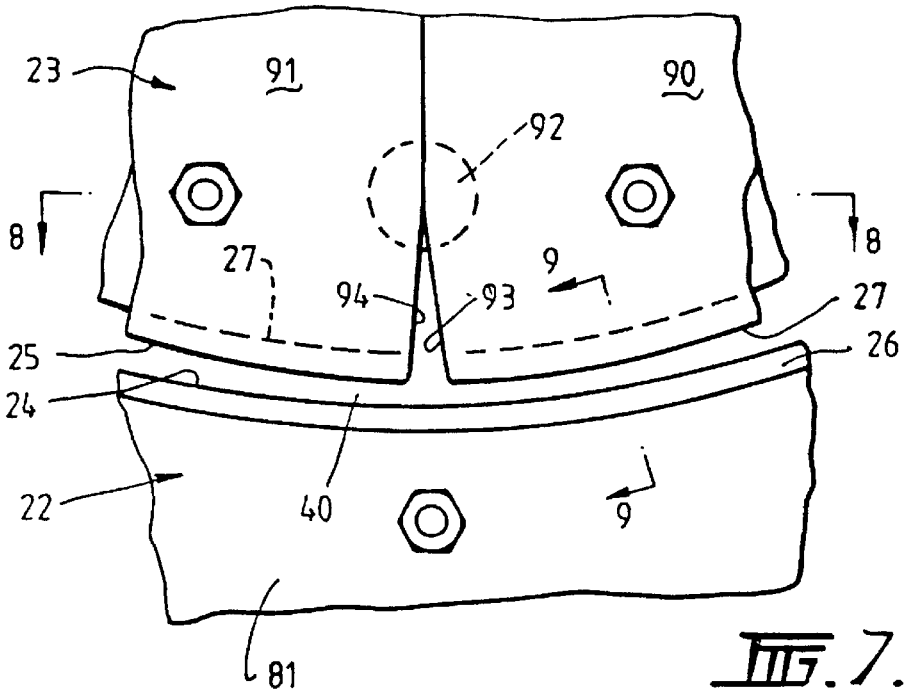
FIG. 7 is an enlarged scrap section of important components illustrated and enclosed by the arrow 7 in FIG. 6.
Figure 8:
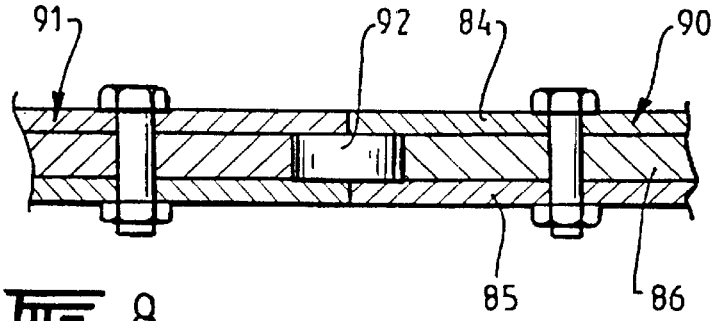
FIG. 8 is a cross-sectional view of the components illustrated in FIG. 7 taken along the line 8—8.

The cold-forming die means 30, as best seen in FIG. 6, mounted on intermediate transverse members 21 of the frame 1, comprise a set of coextensive generally in register dies between which the strip 6 is received. The set comprises a male die 22 having a concave leading edge 24 and a female die 23 having a convex leading edge 25. The arcuate nip 40 is formed by the leading edges 24, 25 of the dies 22, 23. The male die 22 and female die 23 are driven towards one another to plastically deform the strip 6 into a channel section. The concave leading edge 24 is provided with a coextensive protrusion 26 and the convex leading edge 25 is provided with a coextensive recess 27. At the same time that the dies 22, 23 mate to plastically deform the strip 6 into channel section, the protrusion 26 and recess 27 of the respective dies 22, 23 mate to form a transverse rib 28 in the strip 6.

The dies 22, 23 are mounted on respective sets of crankshafts 38,39 driven by means of a chain and sprocket arrangement. The dies 22, 23 are geared to each other to maintain the protrusion 26 of the male die 22 in register with the recess 27 of the female die 23 thereby portions of the strip 6 are pushed into the recess 27 to permanently deform the strip 6 to form a rib 28.

The strip 6 is passed into the nip 40 between the male and female dies 22, 23. The dies 22, 23 are provided with cooperating orbital motions that bring the dies 22, 23 together to form a rib 28 in the strip 6 and to form the strip 6 into channel section. The dies 22, 23 engage respective opposite sides of the strip 6 as it travels along a transit path through the apparatus, plastically deform the engaged portions of the strip 6 to form a transverse rib 28 and advance with the sheet as deformation occurs then releases the ribbed strip 6 as the strip 6 advances on further along its transit path. At the same time, by virtue of their respective concave and convex edges 24, 25 the dies 22, 23 plastically deform the sheet into a channel section. The step is repeated with each sweep of the dies 22, 23 thereby forming a multiplicity of ribs 28. In the illustrated embodiment the ribs 28 are in the form of corrugations. The corrugations are substantially sinusoidal in cross-section and extend transversely across a major portion of the strip 6.

Each die 22, 23 maintains its orientation in relation to the other die as it sweeps about its orbital path. FIGS. 10 to 13 illustrate in scrap side view the orbital path of the dies 22, 23.

As illustrated in FIG. 6, the crank mechanism comprises two sets of four crankshafts 38, 39 each set respectively rotatably supporting each die 22, 23. Four bearing housings are mounted on each die 22, 23, with two housings disposed on opposite edge margins of each die 22, 23. One pair of housings 31 is mounted towards the leading end of the dies 22, 23 and the other pair of housings 32 towards the trailing end.

Each set of four crankshafts 38, 39 are rotatably supported by eight bearing housings 33 mounted on the frame 1, two housings 33 for each crankshaft, and driven by an electric motor 34, for example, a 7 kW three phase motor, through a chain and sprocket arrangement 35 providing a gear reduction of, for example, five to one. As illustrated by FIGS. 1 and 6, the four drive sprockets 36 which drive crankshafts of the male die 22 rotate the crankshafts in a counterclockwise direction and by running the back of the chains against the drive sprockets 37 of the female die 23 these crankshafts are driven clockwise.

In the illustrated embodiment, the one electric motor 34 drives both the drive chain adjacent one edge of dies 22, 23 and the drive chain adjacent the other edge thereby facilitating synchronisation of movement of the dies 22, 23.

The dies 22, 23 are geared to one another so that they move towards one another to engage the strip 6 received between them, advance with the strip 6 along a transit path therebetween then disengage from the strip 6 as they move further along their respective orbital path created by the movement of the crankshafts. The offset of each crankshaft is, for example, 6½ mm thereby providing each die 22,23 with 13 mm eccentric displacement per revolution.

Figure 13:
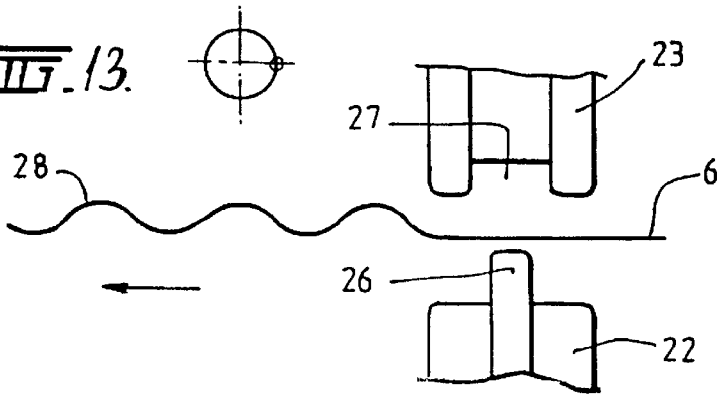
FIG. 13 is a schematic cross-sectional view of the strip and the dies illustrating their relative positions immediately prior to the cold-forming strokes of the respective dies with a scrap illustration of the orbital motion of the female die and the relative position of the leading edge of the female dies at this stage of the cycle.

FIG. 6 illustrates the dies 22, 23 in the retracted position corresponding to that illustrated in FIG. 13.

The dies 22, 23 are thus provided with both vertical and horizontal movement as their cooperating respective concave and convex edges 24, 25 sweep an orbital path (as illustrated in FIGS. 10 to 13 in scrap side view) without departing from their orientation towards one another.

Figure 10:
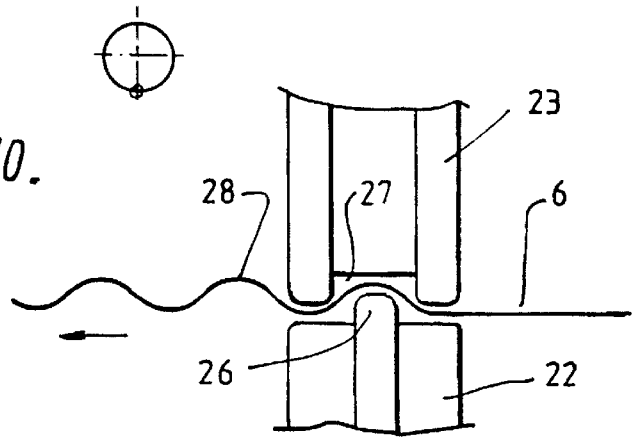
FIG. 10 is a schematic cross-sectional view of the strip and the dies illustrating their relative positions at the end of the cold-forming strokes of the respective dies with a scrap illustration of the orbital motion of the female die and the relative position of the leading edge of the female die at this stage of the cycle.
Figure 11:
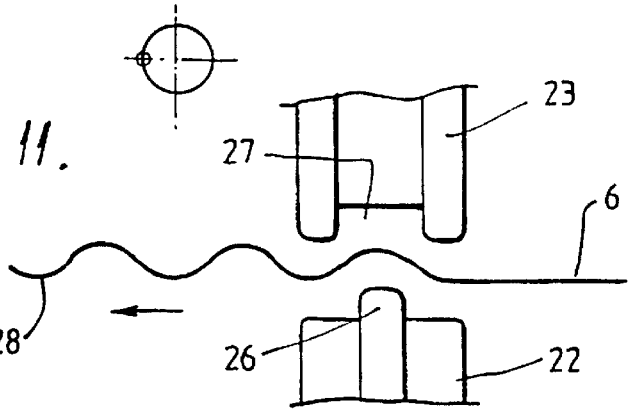
FIG. 11 is a schematic cross-sectional view of the strip and the dies illustrating their relative positions soon after the cold-forming strokes of the respective dies with a scrap illustration of the orbital motion of the female die and the relative position of the leading edge of the female die at this stage of the cycle.
Figure 12:
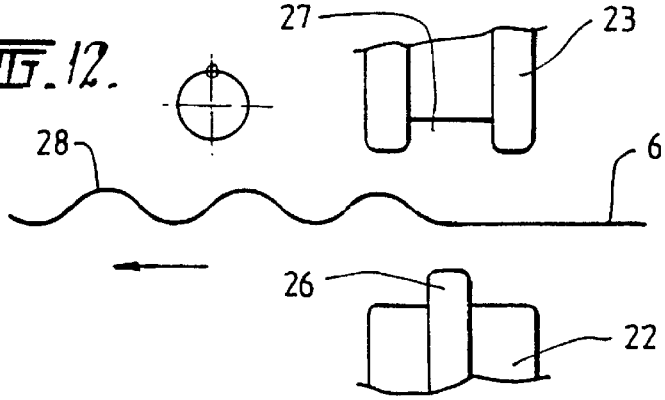
FIG. 12 is a schematic cross-sectional view of the strip and the dies illustrating their relative positions with the dies fully retracted with a scrap illustration of the orbital motion of the female die and the relative position of the leading edge of the female die at this stage of the cycle.

FIG. 10 schematically illustrates the two dies 22, 23 at a position of engagement at an end of a cold-forming step and FIGS. 11 to 13 illustrate their relative positions in three other positions during one orbit of the dies 22, 23. The concave edge 24 and the convex edge 25 lie in register during each orbit. The crankshaft offset may be said to provide the dies 22, 23 with both rotational and reciprocating action which permits continuity of strip feed.

Figure 9:
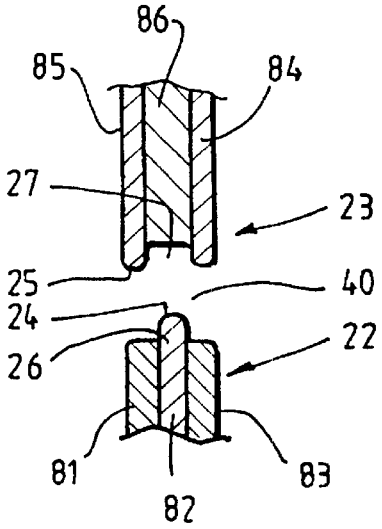
FIG. 9 is a cross-sectional view of the components illustrated in FIG. 7 taken along the line 9—9.

FIGS. 6, 7, 8 and 9 illustrate a preferred embodiment of a male die 22 and female die 23. The male die 22 as illustrated in FIG. 9 in schematic cross-section is formed of three plates 81, 82, 83 bolted together having a concave leading edge 24. The intermediate plate 82 sandwiched between the other two plates 81, 83, extends from the leading end of the die 22, to form a protrusion 26, by a distance in the range of, for example, 10 to 12 mm.

The female die 23 is formed of three plates bolted together having a convex leading edge 25 with two outer plates 84, 85 extending beyond the other thicker plate 86 by a distance in the range of, for example, 10 to 12 mm to provide a channelled leading edge 25.

Appropriate setting up and adjustment of the dies is significant in producing quality elements.

Each die must be accurately set to properly define a nip between them of appropriate radius of curvature.

The dies, once in place, have to be calibrated prior to operation so that the radius of curvature of the leading end of one die substantially corresponds to that of the other.

However, it has been found beneficial to provide means for allowing adjustment of the radius of curvature of the leading edge of at least one of the dies to fine tune the corrugating operation and enable the apparatus to accommodate fluctuations in strip thickness and other strip defects and to accommodate fluctuations due to misalignment and wear of components of apparatus in the cold-forming line. Other problems that may arise include oil canning.

Adjustment of the radius of curvature of the leading edge of one of the dies, generally in the order of only a few millimeters, can significantly ameliorate such problems.

Adjustment means may also reduce the need to cease operation and remove and replace one of the dies with another of differing leading edge radius of curvature.

In accordance with one preferred aspect of the invention there is provided means for allowing the leading edge of the female die to change its arcuate radius of curvature.

To this end, the female die 23 is formed in two identical half segments 90, 91 which are held side to side to form the completed die 23 having a leading end and a tailing end.

FIGS. 6, 7, 8 and 9 illustrate the construction of the die segments which are supported on the frame by means of bearings and cranks as described previously. The half segments 90, 91 are provided with a gap of, for example, 2 mm to 3 mm between adjacent corners 93, 94 of the leading end of the die. The gap may be provided by bevelling, such as, for example, shaving off 1–1.5 mm from each adjacent corner 93, 94 of the half segments 90, 91.

The leading edge 25 of each half segment 90, 91 is of generally channel formation so that the die defines a channel 27 to receive the leading edge protrusion 26 of the male die 22. 23.

The half segments 90,91 are hinged to one another at a position towards the leading end of the die 23 by a pivot pin 92 so that the gap can be provided between the half segments at the leading edge of the die 23. The width of the gap can be preset and/or may be adjusted after start up. In this way the radius of curvature of the female die 23 can be adjusted to differ from that of the male die 22, generally by the order of only a few millimeters to address operational problems that may arise.

That is to say, adjacent leading portions of the segments are hinged one to the other to permit adjacent corners 93, 94 of leading portions of the segments 90, 91 to be spaced apart a predetermined distance and to be moved towards and away from one another to permit adjustment to said spacing and thus the radius of curvature of the leading edge.

Additionally the present preferred embodiment enables discrete adjustment of one half segment alone thereby providing more precision in the fine tuning of the apparatus than has previously been possible.

A primary purpose of providing means to vary the radius of curvature of the dies is to assist in fine tuning the cold-forming step and as such may be used to address oil canning problems which can arise during operation of the apparatus due to variations in strip thickness, et al.

Means to adjust the radius of curvature of the leading edge of a die is provided, inter alia, to address the problem of excessive oil-canning at the top of the channel and to enable the apparatus to provide a substantially constant corrugation by means of either lessening or increasing the depth of the corrugation towards the ends of the corrugation. The adjustment means according to the preferred embodiment facilitates elimination of any sign of oil-canning which may appear in the portion of the channel at the ends of the corrugations which are devoid of corrugations. If the channel is excessively corrugated the dies tends to pull said portion into compression and create problems there.

The adjustment means facilitates control of the apparatus in striking a compromise between excessive oil-canning and excessive corrugation.

Additionally, the present embodiment of the female die enables adjustment of the position of either segment of the die to effectively enable the depth of the corrugation on one side of the element to be changed without altering the other side.

As illustrated in FIG. 1, the ribbed strip 6 issues from the dies 22, 23 and passes to edge forming means disposed immediately downstream of the dies means 30. The edge forming means is in the form of two pairs of sets of coextensive edge forming rollers 41, 42 with each pair of sets of rollers 41, 42 operating on a respective longitudinal edge of the strip 6 to form flanged edges 70, 71.

The strip 6 enters the sets of edge forming rollers 41, 42 where it is gripped along its edge margins. As it issues from the edge formers the formed element is directed upwardly, as illustrated by FIG. 1.

Figure 14:
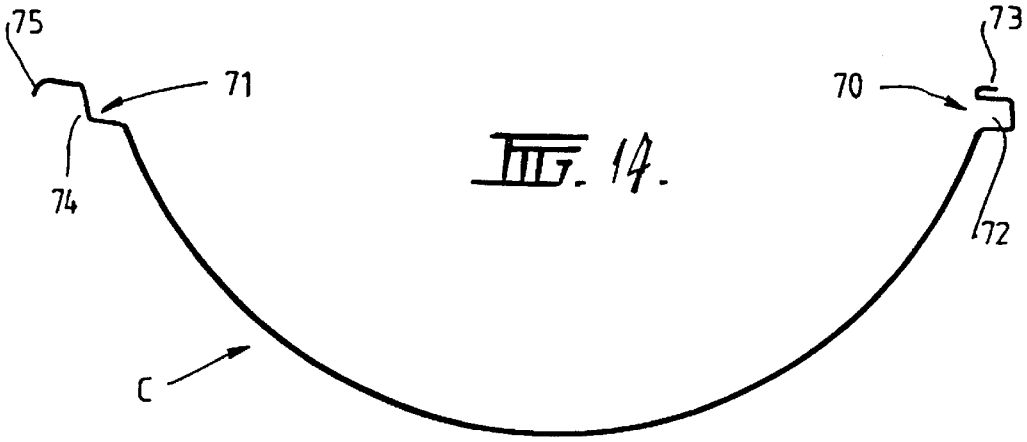
FIG. 14 is a schematic cross-sectional view of preferred embodiment of a building element in accordance with a preferred embodiment of the invention taken along the line 14—14 of FIG. 1.
Figure 15:
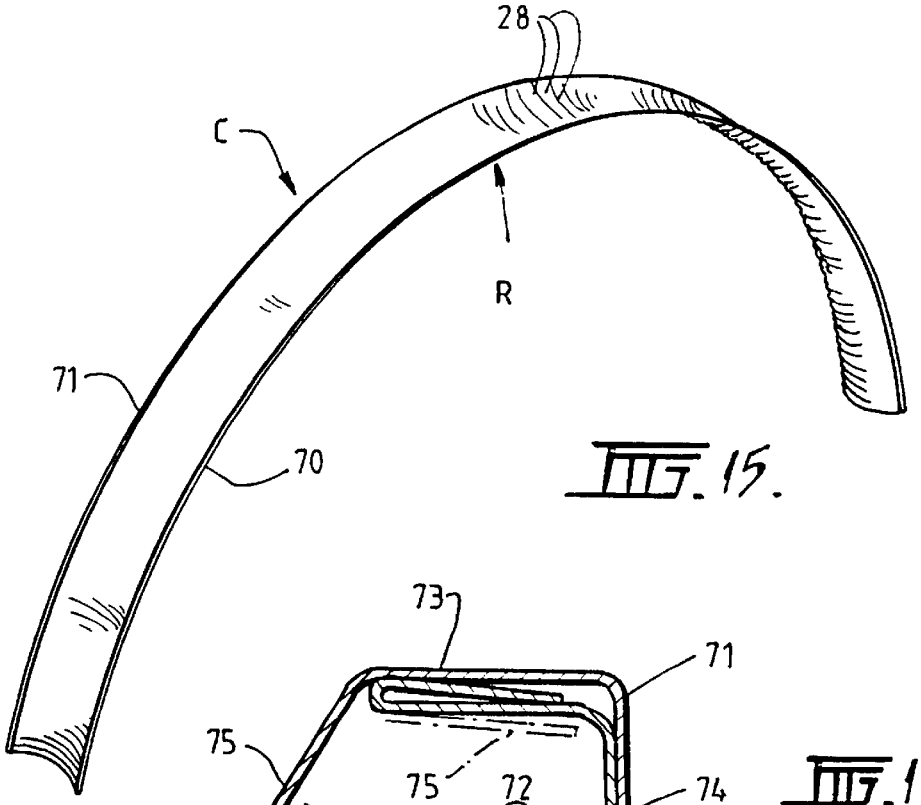
FIG. 15 is a schematic perspective view of a building element in accordance with a preferred embodiment of the invention.

The apparatus is also provided with a set of shears (not shown) which cuts the formed strip into building elements of predetermined length. The strip 6 issuing from the apparatus has a longitudinal radius of curvature R which forms an upwardly convex building element as best illustrated by FIG. 15. The depth of the channel as best illustrated by FIG. 14 is in the order of 300 mm.

The requisite building element is formed in one pass through the apparatus and may be launched directly to its location in the building being erected.

Figure 16:
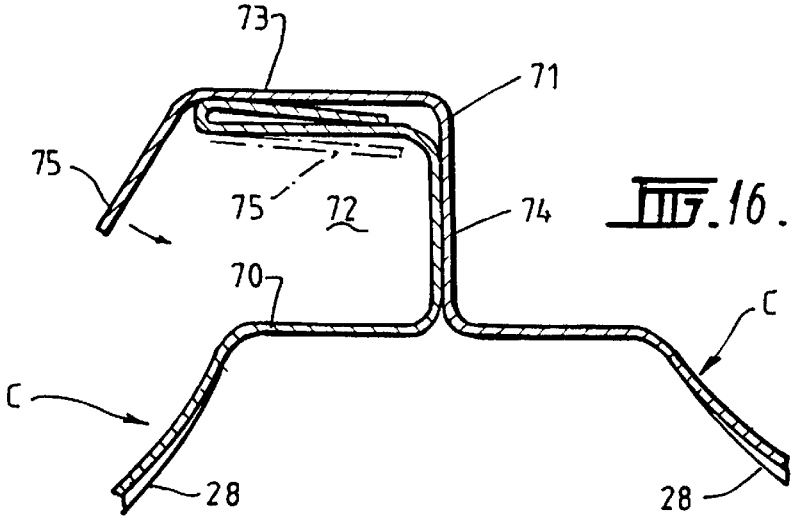
FIG. 16 is a schematic enlarged cross-sectional view of important components of a pair of building elements formed in accordance with a preferred embodiment of the invention.

FIG. 15 is a schematic perspective view of an element constructed according to a preferred embodiment of the invention and FIG. 16 is a cross-sectional view of a joint between two neighbouring elements having a female edge flange 71 and a male edge flange 70. The male edge flange formation 70 is of generally C-section having an inwardly opening mouth 72 and having an out turned lip 73 folding back towards a distal outer face of the C-section and the female edge flange formation 71 is of generally upwardly and outwardly extending L-section 74 having a down turned edge margin 75, said edge margin 75 being adapted in use to fold back towards the L-section 71. Edge flanges of the kind illustrated facilitate jointing of adjacent elements edge to edge. Elements produced by the illustrated machine are typically 840–850 mm wide and 300 mm deep and as such are too heavy to be handled safely by manual labour.

In assembling the elements, it is advantageous to movably support each element as it is being located in position. Once the first element is positioned subsequent elements are readily positioned side by side with neighbouring edge flanges 70, 71 overlapping. The overlapped flanges 70, 71 may then be secured to one another by folding or bending the edge margin of flange 71 under the edge margin of flange 70 as illustrated in phantom outline in FIG. 16. Alternatively the overlapping edge flanges may be clinched or otherwise fastened to one another.

Figure 19:
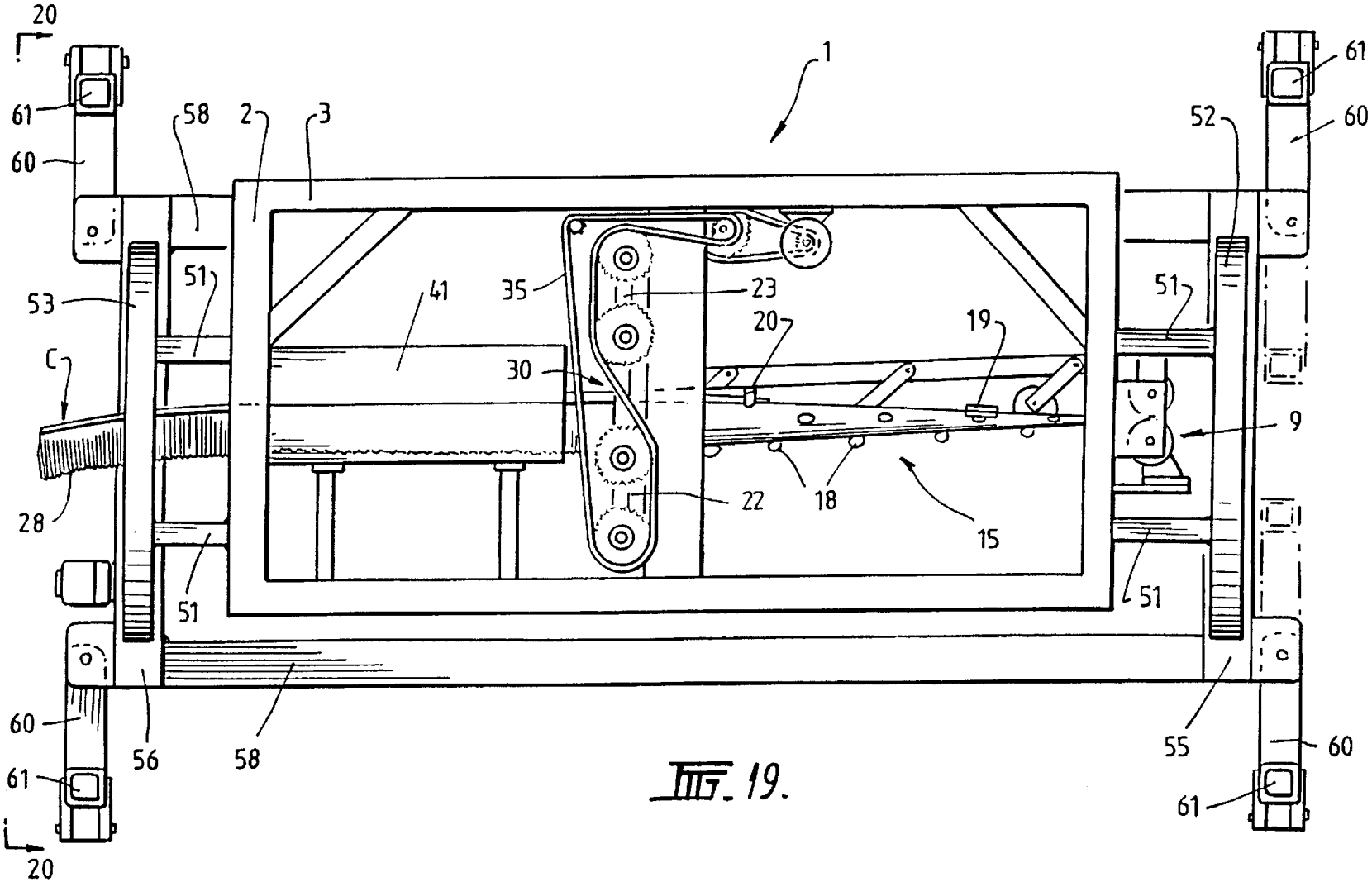
FIG. 19 is a schematic plan view of cold-forming apparatus in accordance with a preferred embodiment of another aspect of the invention.
Figure 20:
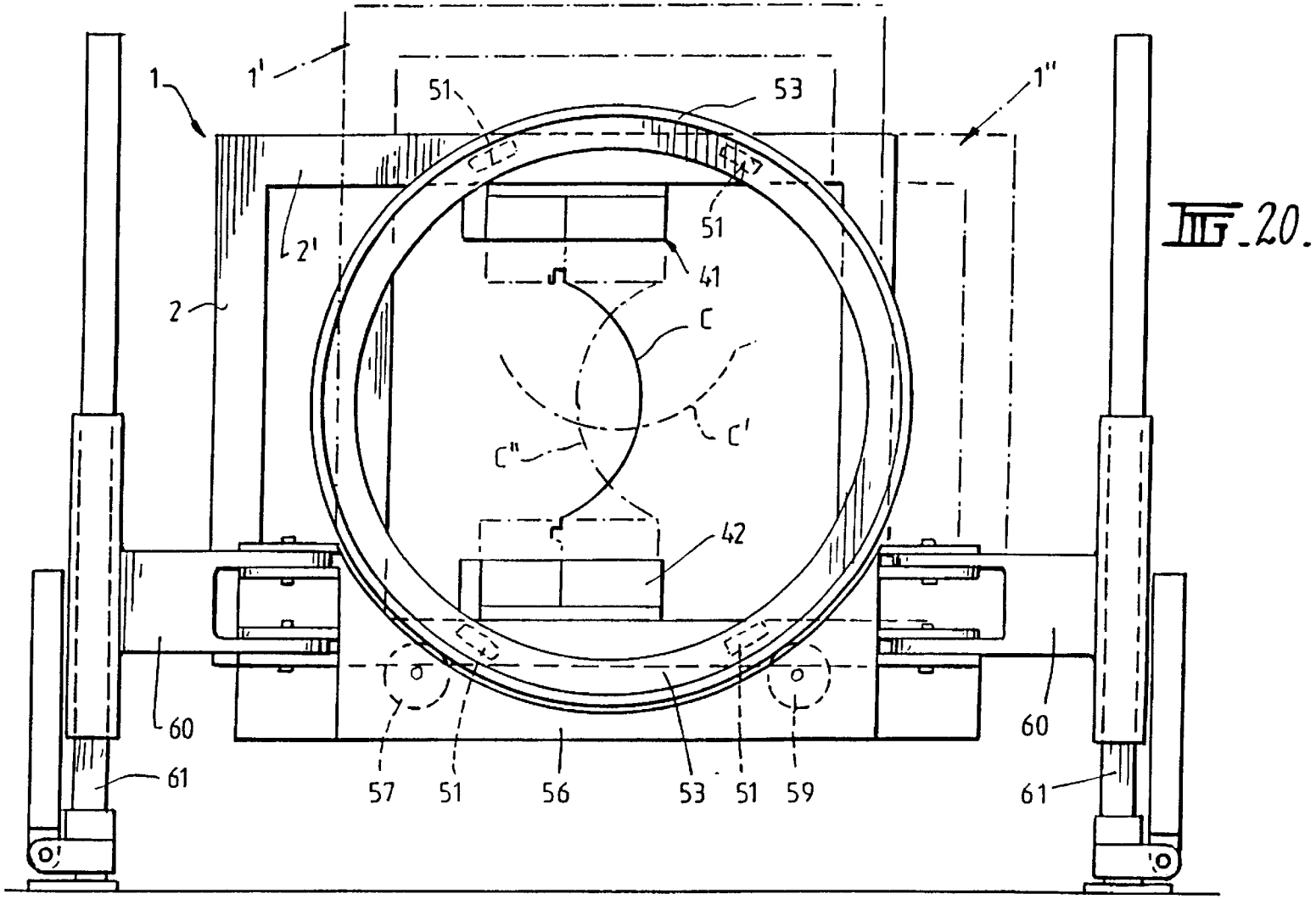
FIG. 20 is a schematic side elevation view of cold-forming apparatus illustrated in FIG. 19 along the line 20—20 of FIG. 19.

In another embodiment in accordance with another aspect of the invention and as illustrated in FIG. 19 in plan view and FIG. 20 taken along the line 20—20 of FIG. 19, the frame 1 is supported on a cradle to turn the frame 1 about a longitudinal axis substantially parallel to the travel path of the strip through the machine and hold it at a discrete orientation so that the element may issue at any desired discrete orientation. The longitudinal axis of the frame 1 may, for example, be supported to extend substantially horizontally and the frame 1 may be turned 90° from the orientation of the frame as illustrated in FIG. 1. The element C may thus issue from the trailing end of the frame 1 on its edge and move towards one side of the frame 1 onto a runout table (not shown) rather than being launched into the air directly to its location in the building being erected.

Figure 17:
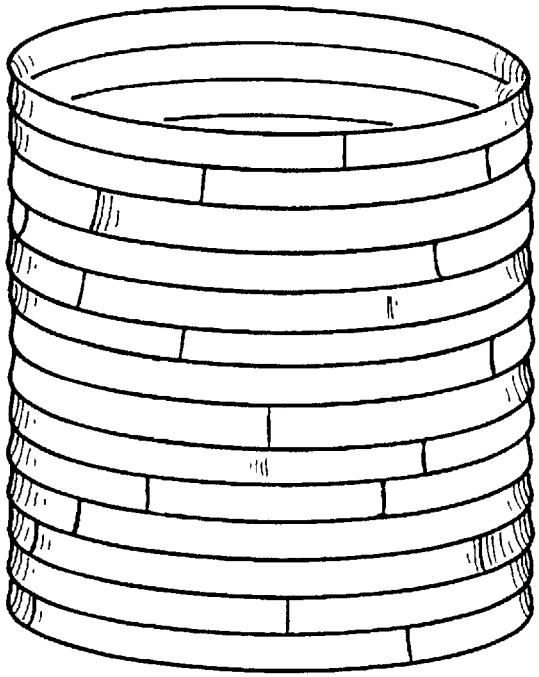
FIG. 17 is a schematic perspective view of a building made of elements in accordance with a preferred embodiment of the invention.

In accordance with a preferred embodiment, an array of elements issuing on their edge are joined (preferably by a splined overlap joint) sequentially end to end on the runout table to form a cylinder. Means are provided to raise the cylinder to by a distance exceeding the height of the cylinder on the runout table so that a subsequent array of elements can be joined to one another to form another cylinder. The cylinders are then jointed to one another edge to edge. The jointed cylinders are then raised by a distance exceeding the height of one cylinder so that the next cylinder can be assembled on the runout table and subsequently jointed to the cylinder above. In this manner a building of the kind illustrated in FIG. 17 having a cylindrical peripheral wall can be assembled. Once sufficient cylinders are jointed, the jointed assembly may be lowered towards the ground so that the lowermost cylinder sits on its edge on a foundation. The roof may be preformed or assembled on site and may be applied to the uppermost cylinder either prior to that cylinder being raised on the runout table, after the assembly has been placed on foundations or at any other stage of construction.

In another embodiment, the length of the element may be sufficient to enable its leading end to joined to its trailing end to form a cylinder.

Figure 18:
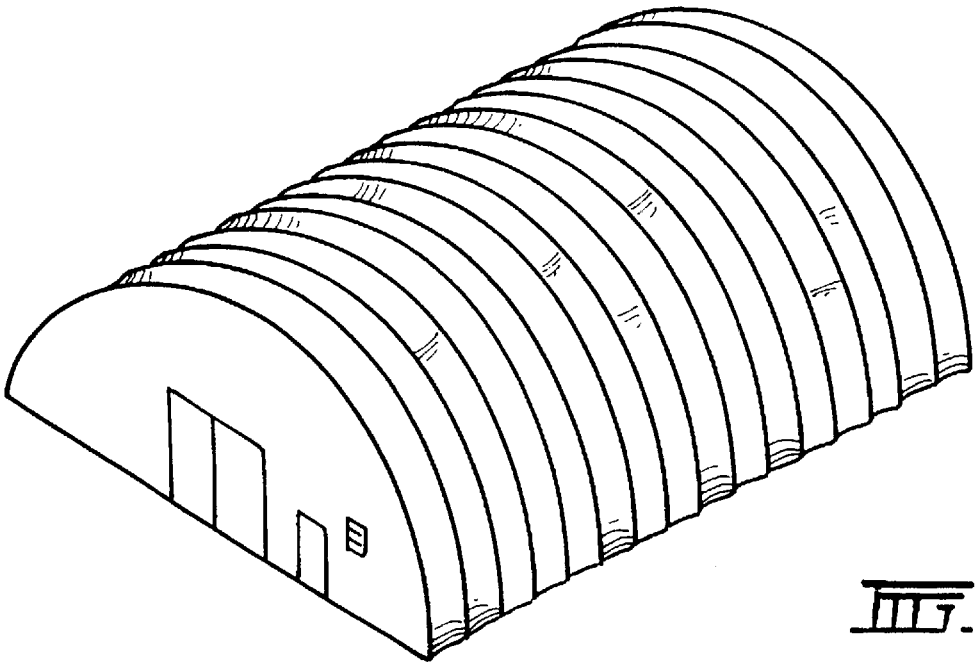
FIG. 18 is a schematic perspective view of another building made of elements in accordance with a preferred embodiment of the invention.

In yet another embodiment, the array of elements on the runout table may be sequentially joined end to end to form a constructional element of semi circular cross-section or the element may be cut to a length to form a constructional element of semi circular cross-section. These constructional elements may be raised and jointed in a fashion similar to that described in relation to the cylinders except in this case the jointed assembly is hoisted into position to form a building of the kind illustrated in FIG. 18.

Important components of the machine of this embodiment, such as, for example, the frame, the set of cold-forming die means, edge forming means, guide means and strip drive means are identical to those described with reference to FIGS. 1 to 18.

As illustrated in FIG. 19 the frame 1 is provided with a pair of steel rings 52, 53, each ring 52, 53 being welded to a respective end of the frame 58 by means of struts 51. Cradle means comprises a cradle 55, 56 at each end of the frame 1 joined to one another by a pair of beams 58. Each cradle 55, 56 has two frame support rollers 57, 59 supporting each of the two steel rings 52, 53 thereby enabling the frame 58 to sit in and discretely rotate on the cradle means. Each ring 52, 53 is turned in synchronisation with the other by a chain drive (not shown) in which a duplex chain wraps around three sprockets at each ring 52, 53 and are driven at a controlled speed of turning.

In this embodiment the uncoiler is arranged to turn about a transverse axis of the coil in synchronisation with the turning of the frame so as to continue to present the strip to the drive rollers 11 in the same orientation.

Each of the four corners of the cradle means is provided with swing-out legs 60. The legs 60 may be engaged by hydraulic jacks 61 to raise and lower the structure.

FIG. 20 illustrates a preferred orientation of the frame and and associated orientation of the element C issuing from the machine. Illustrated in phantom outline are two other orientations of the frame 1', 1" and the element C', C" wherein the frame has been turned about a longitudinal axis of the frame by 90 degrees and 180 degrees respectively from that illustrated.

The structure may be raised and lowered to enable the machine to be loaded onto a vehicle tray. Additionally, it may be necessary to raise and lower the structure to enable the frame 1 to be turned about its longitudinal axis.

Particular embodiments of the invention have been described and illustrated by way of example, but it will be appreciated that other variations of and modifications to the invention can take place without departing from the spirit and scope of the invention. For example, the building elements may be used to construct a roof structure of a building or may be used to form the walls of a grain silo or like building. Additionally the dies may be designed to enable two or more corrugations to be formed simultaneously, that is to say, with each orbit of the dies.

Further the radius of orbit of the dies of the preferred embodiments illustrated is fixed. However, it would be possible to manufacture a machine with an adjustable radius on those cranks so as to provide an adjustable radius of orbit so as to provide the dies with a bigger pitch or a smaller pitch.

Additionally further, whereas orbital motion of the dies is preferred, the dies may, for example, be moved in simultaneously separate reciprocating motions in transverse planes to effect said plastic deformation of the strip. For example the dies may be driven in simultaneous separate reciprocating horizontal and vertical motions.

What is claimed is:

1. Apparatus for forming an elongate longitudinally arcuate building element of channel cross-section having transverse ribs from sheet metal comprising a set of coextensive generally in register dies through which a sheet of metal can be received, said set comprising a male die and a female die which cooperate to form transverse ribs in the sheet wherein further one of said male die and female die is provided with a concave leading edge and the other die is provided with a convex leading edge thereby the dies cooperate to plastically deform the sheet into a channel section, the dies being provided with orbital motions which cooperate to bring the dies into engagement with the sheet, draw the sheet along a transit path therebetween while cold-forming the sheet and then disengage the sheet with each sweep about their orbits.

2. Apparatus according to claim 1 wherein the male die is provided with an upright protrusion projecting from its leading edge and extends along at least part of its length.

3. Apparatus according to claim 1 wherein the female die is provided with a coextensive recess extending along at least part of its length.

4. Apparatus according to claim 2 wherein the protrusion extends a major portion of its respective edge.

5. Apparatus according to claim 3 wherein the recess extends a major portion of its respective edge.

6. Apparatus according to claim 1 wherein the leading edges remain in register during operation of the apparatus.

7. Apparatus according to claim 1 wherein the said set of dies are mounted on crank mechanisms to provide the dies with said cooperating orbital motions.

8. Apparatus according to claim 1 wherein the dies engage respective opposite sides of the sheet as it travels along a transit path through the apparatus, plastically deform the engaged portions of the sheet to form transverse ribs and advance with the sheet as deformation occurs, then release the sheet as it advances further along its transit path.

9. Apparatus according to claim 1 wherein guide means are provided in advance of the dies to receive the strip from a coil in a substantially flat configuration and pass the strip to an arcuate nip formed by the leading edges of the dies in a shape corresponding generally to that shape in cross-section without plastically deforming the strip.

10. Apparatus according to claim 1 wherein the apparatus further comprises edge flange forming means to operate on each longitudinal edge of the sheet.

11. Apparatus according to claim 10 wherein the edge flange forming means comprise at least two pairs of cooperating edge forming rollers with each pair of rollers operating on a respective longitudinal edge to form flanged edges.

12. Apparatus according to claim 10 wherein the flanged edges of each sheet is formed as respective male and female formations so that two elements disposed side by side with overlapped flanged edges enable the male formation of one element to nestle in the female formation of the other element.

13. Apparatus according to claim 1 wherein the sheets are provided from a coil of strip and that the apparatus further comprises shears to cut said strip into sheets of predetermined length.

14. Apparatus according to claim 13 wherein the shears are provided downstream of the forming dies so that the cold-formed strip is cut into cold-formed elements.

15. Apparatus according to claim 1 wherein the transverse ribs comprise corrugations.

16. Apparatus according to claim 1 wherein the dies are so geared to one another that they move towards one another to engage the strip received between them, advance with the strip along a transit path therebetween then disengage from the strip as they move further along respective orbital path created by movement of crankshafts.

17. Apparatus according to claim 16 wherein each crankshaft is offset to provide each die with eccentric displacement with respect to a frame thereby providing the dies with both rotational and reciprocating action which permits continuity of strip feed.

18. Apparatus according to claim 16 wherein the dies are provided with both vertical and horizontal movement as their cooperating respective concave and convex edges sweep said orbital path without departing from their orientation towards one another.

19. Apparatus according to claim 1 wherein the apparatus further includes a frame having transverse generally parallel and coextensive members and longitudinal generally parallel and coextensive members which are joined together to form a "box" configuration.

20. Apparatus according to claim 19 wherein the frame is mounted to rotate about a longitudinal axis of a travel path of strip passing through the frame to enable the frame to be oriented at discrete orientations about said axis.

21. Apparatus according to claim 19 wherein mounted within the frame are the set of forming dies, an edge forming means, a strip guide means and a strip drive means.

22. Apparatus according to claim 21 wherein the strip drive means comprises a pair of coextensive substantially parallel drive rolls between which strip is received from the coil and issued in a substantially flat configuration, and is provided in advance of the dies.

23. Apparatus according to claim 19 wherein guide means are provided to pass the strip to an arcuate nip formed by the leading edges of the dies in a shape corresponding generally to that shape in cross-section without plastically deforming the strip.

24. Apparatus according to claim 21 wherein said edge forming means is in the form of two pairs of coextensive edge forming rollers with each pair of rollers operating on a respective longitudinal edge of the strip to form a flanged edge.

25. Apparatus according to claim 19 wherein the set of cold-forming dies are mounted on intermediate transverse members of the frame.

26. Apparatus according to claim 1 wherein the dies are provided with means to adjust the radius of curvature of either or both the respective concave leading edge or the convex leading edge.

27. Apparatus according to claim 26 wherein adjustment of the radius of curvature of a leading edge is effected by means of providing a female die formed of a plurality of segments held side to side having a gap provided between at least a portion of each of the segments, the width of the gap being adjustable so as to effect adjustment of the radius of curvature of the leading edge.

28. Apparatus according to claim 1 wherein any one of the male die and the female die is formed of two substantially identical half segments.

29. Apparatus according to claim 28 wherein the half segments are hinged to one another towards their leading end.

30. A process of forming an elongate longitudinally arcuate building element of channel cross-section having transverse ribs from sheet metal comprising the steps of; directing sheet material to a nip of a set of dies, providing a set of coextensive generally in register dies having a nip through which a sheet of metal can be received, said set comprising a male die and a female die which cooperate to form transverse ribs in the sheet wherein further one of said male die and female die is provided with a concave leading edge and the other die is provided with a convex leading edge thereby the dies cooperate to plastically deform the sheet into a channel section and driving said dies to bring them together to form said transverse ribs in the sheet and to plastically deform the sheet into channel section prior to disengaging the cold-formed element, the dies being provided with orbital motions which cooperate to bring the dies into engagement with the sheet, draw the sheet along a transit path therebetween while cold-forming the sheet and then disengage the sheet with each sweep about their orbits.

31. A process according to claim 30 wherein the leading edges are held in register during operation of the apparatus.

32. A process according to claim 30 wherein the said set of dies are mounted on crank mechanisms to provide the dies with said cooperating orbital motions.

33. A process according to claim 30 wherein the process further comprises the step of edge flange forming each longitudinal edge of the sheet.

34. A process according to claim 30 wherein the process includes the step of providing metal sheets from a coil of strip and then cutting said strip into sheets of predetermined length.

* * * * *